US006765352B2

(12) United States Patent
Ohtomo et al.

(10) Patent No.: US 6,765,352 B2
(45) Date of Patent: Jul. 20, 2004

(54) PHOTOCATHODE AND ELECTRON TUBE

(75) Inventors: Akihiko Ohtomo, Hamamatsu (JP); Tsuneo Ihara, Hamamatsu (JP); Kuniyoshi Mori, Hamamatsu (JP); Yoshiyuki Natsume, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 10/343,229

(22) PCT Filed: Jul. 26, 2001

(86) PCT No.: PCT/JP01/06441

§ 371 (c)(1),
(2), (4) Date: Jan. 30, 2003

(87) PCT Pub. No.: WO02/11168

PCT Pub. Date: Feb. 7, 2002

(65) Prior Publication Data

US 2003/0146698 A1 Aug. 7, 2003

(30) Foreign Application Priority Data

Jul. 31, 2000 (JP) ..... 2000-231993

(51) Int. Cl.[7] ..... H01J 40/06; H01J 40/16; H01J 40/00; H01J 40/18; H01J 40/14

(52) U.S. Cl. ..... 313/542; 313/523; 313/524; 313/530; 313/532; 313/537; 313/538; 313/544; 313/103 R; 313/103 CM; 313/104; 313/10 R; 313/105 CM; 250/214 VT

(58) Field of Search ..... 313/523–544, 313/103–105; 250/214 VT

(56) References Cited

U.S. PATENT DOCUMENTS 3,310,701 A * 3/1967 Heimann ..... 313/542
3,917,950 A * 11/1975 Carlson ..... 250/483.1
6,586,877 B1 * 7/2003 Suyama et al. ..... 313/523

FOREIGN PATENT DOCUMENTS

JP A 8-96705 4/1996
JP A 10-241554 9/1998

* cited by examiner

*Primary Examiner*—Nimeshkumar D. Patel
*Assistant Examiner*—Matt Hodges
(74) *Attorney, Agent, or Firm*—Oliff & Berridge, PLC

(57) ABSTRACT

A photocathode and an electron tube in which the photocathode plate can be securely fixed without using any adhesive. Even under the severe condition that a high vibration resistance is required or thermal stress occurs because of great temperature variation, it can be used widely for an image intensifier, a streak tube, or a photomultiplier. The photocathode plate of the photocathode is sandwiched between a faceplate and a support plate. First pins embedded in the faceplate are joined to the support plate. Therefore, the photocathode plate can be readily fixed securely to the faceplate without using any adhesive.

18 Claims, 7 Drawing Sheets

PHOTOCATHODE AND ELECTRON TUBE

TECHNICAL FIELD

The present invention relates to a photocathode and an electron tube.

BACKGROUND ART

An electron tube is a device for detecting faint light using a photocathode that emits electrons in response to incident light. Examples of electron tubes include a photomultiplier tube, a streak tube, and an image intensifier. Japanese patent application publication 8-255580 discloses an electron tube having a field-assisted photocathode as an electron tube having sensitivity to longer wavelength light. In this photocathode, a bias voltage is applied between both surfaces of the photocathode, causing electrons to be accelerated by the electric field generated in the photocathode plate and emitted into a vacuum. In this construction, the photocathode is attached to a body of the electron tube by adhesive.

However, the following problems arise in conventional electron tubes one of the problems is that the photocathode is easily peeled off due to thermal stress generated by vibrations and/or temperature variations near 100° C. occurring when the electron tube is cooled for use at about −70° C. The photocathode does not achieve sufficient strength, because the photocathode is adhered to the electron tube using an adhesive. Another problem arises when gas generated from the adhesive degrades the degree of vacuum in the electron tube.

In view of the foregoing, it is an object of the present invention to provide a photocathode in which a photocathode can be reliably fixed without using adhesive, and an electron tube equipped with the above photocathode.

DISCLOSURE OF THE INVENTION

The photocathode according to the present invention includes a faceplate having a light incident surface on which light is incident and a light transmissive surface through which the incident light is transmitted; a photocathode plate in contact with the light transmissive surface of the faceplate for emitting electrons from an electron emitting surface disposed on the opposite side of the surface of contact with the light transmissive surface in response to incident light; a first pin embedded in the faceplate and extending between the light incident surface of the faceplate and the portion of the light transmissive surface that does not contact the photocathode plate; and a support plate joined to the first pin on the light transmissive surface and contacting the outer edge of the electron emitting surface of the photocathode plate to fix the photocathode plate to the faceplate.

With this photocathode construction, the photocathode plate can be easily and reliably fixed to the faceplate without using adhesive. Particularly, the photocathode plate can be joined to the faceplate using metallic first pin and a metallic support plate by welding or soldering the metallic first pin to the metallic support plate.

Here, preferably, a voltage is applied to the photocathode plate through the first pin and the support plate. Accordingly, wiring on the light transmissive surface for applying a voltage to the light transmissive surface of the faceplate is not necessary.

Preferably, the photocathode can be provided with a second pin formed from metal and embedded in the faceplate. The second pin is positioned between the light incident surface and the portion of the light transmissive surface contacting the photocathode plate to be electrically connected to the photocathode plate. A voltage can be applied to the photocathode plate via the second pin. With this construction, wiring on the light transmissive surface for applying voltages to the light transmissive surface side of the faceplate is not necessary.

Further, a bias voltage can be applied between both surfaces of the photocathode plate. Accordingly, a field-assisted type photocathode plate can be easily and reliably fixed to the faceplate without using adhesive.

Preferably, the photocathode can be provided with a second pin formed from metal and embedded in the faceplate. The second pin extends between the light incident surface and a portion of the light transmissive surface contacting the photocathode plate to be electrically connected to the photocathode plate. One end of a bias voltage source can be connected to the photocathode plate via the second pin. With this construction, wiring on the light transmissive surface for applying a bias voltage to the light transmissive surface side of the faceplate is not necessary.

Preferably, one end of a bias voltage source can be connected to the photocathode plate via the first pin and the support plate. With this construction, wiring on the light transmissive surface for applying a bias voltage to the light transmissive surface side of the faceplate is not necessary.

Preferably, the photocathode can, be provided with a second pin formed from metal and embedded in the faceplate. The second pin extending between the light incident surface and a portion of the light transmissive surface contacting the photocathode plate to be electrically connected to the photocathode plate. Preferably, the other end of the bias voltage source is connected to the photocathode plate via the second pin. With this construction, wiring on the light transmissive surface for applying the bias voltages between both sides of the faceplate is not necessary.

When the support plate is formed from metal, it is preferable to provide an insulating holder around the photocathode plate. With this construction, in case that the photocathode plate is moved for any reason toward the support plate, the insulating holder can prevent short-circuit between a side surface of the photocathode plate and the support plate.

Preferably, the photocathode plate can include a plurality of first pins. This structure enables the photocathode plate to be more reliably fixed to the faceplate.

Preferably, the second pin can be electrically connected to the photocathode plate via a conductive member. With this construction, the conductive member serves as an electrode to efficiently apply a voltage to the photocathode plate.

Further, the faceplate exhibits sufficient functions, provided only the portion of the faceplate that guides light onto the photocathode plate is formed from a light transmissive member.

Further, the support plate is a flat plate having a stepped through-hole. The stepped through-hole can have a rim portion which contacts an outer edge of the electron emitting surface in the photocathode plate to fix the photocathode plate to the faceplate. This construction facilitates production of the photocathode.

The usage of the above photocathode plate can provide an electron tube such as an image intensifier, streak tube, or photomultiplier tube. And the electron tube exhibits sufficiently proper characteristics.

BEST MODE FOR CARRYING OUT THE INVENTION

Figure 1:
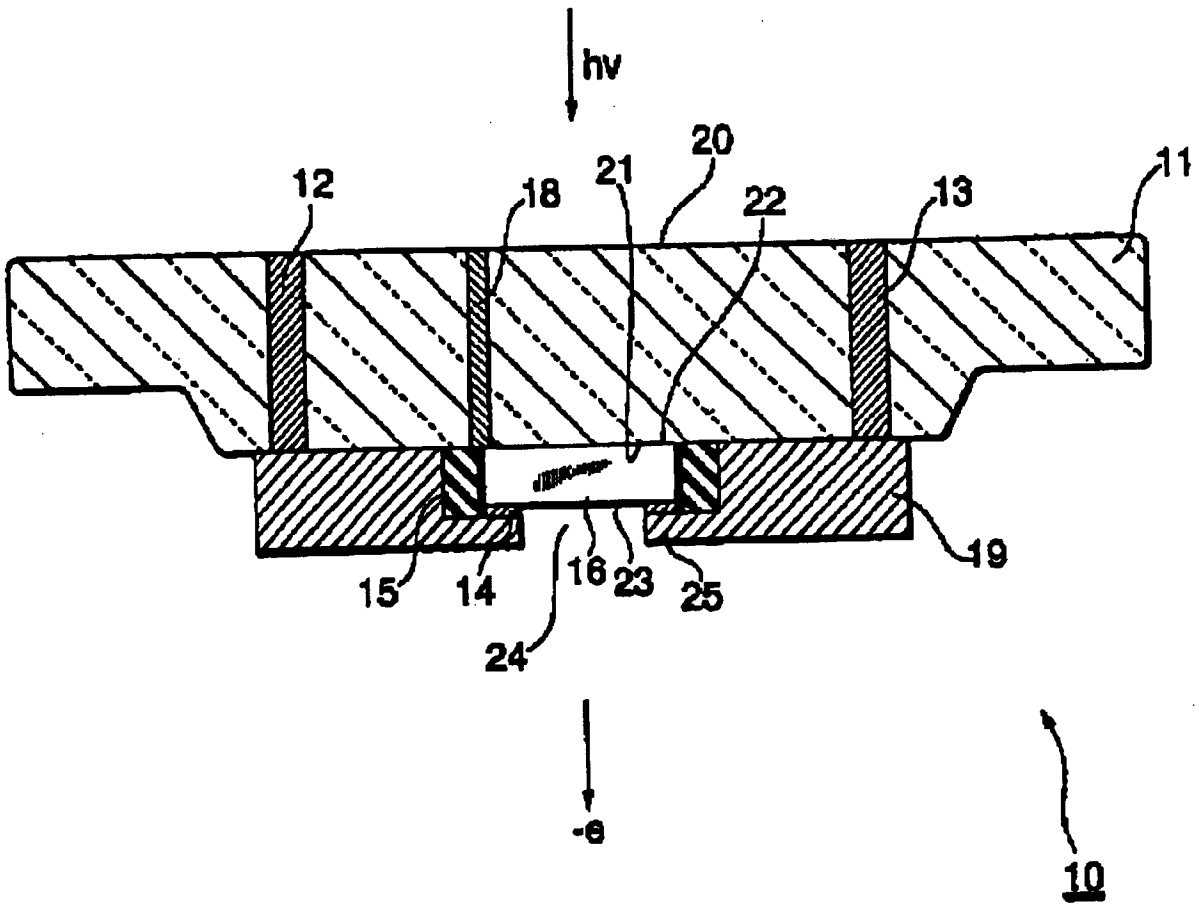
FIG. 1 is a cross-sectional view showing a photocathode according to a first embodiment.

Next, a photocathode and an electron tube according to preferred embodiments of the present invention will be described while referring to the accompanying drawings, wherein like parts and components are designated by the same reference numerals to avoid duplicating description.

Figure 2:
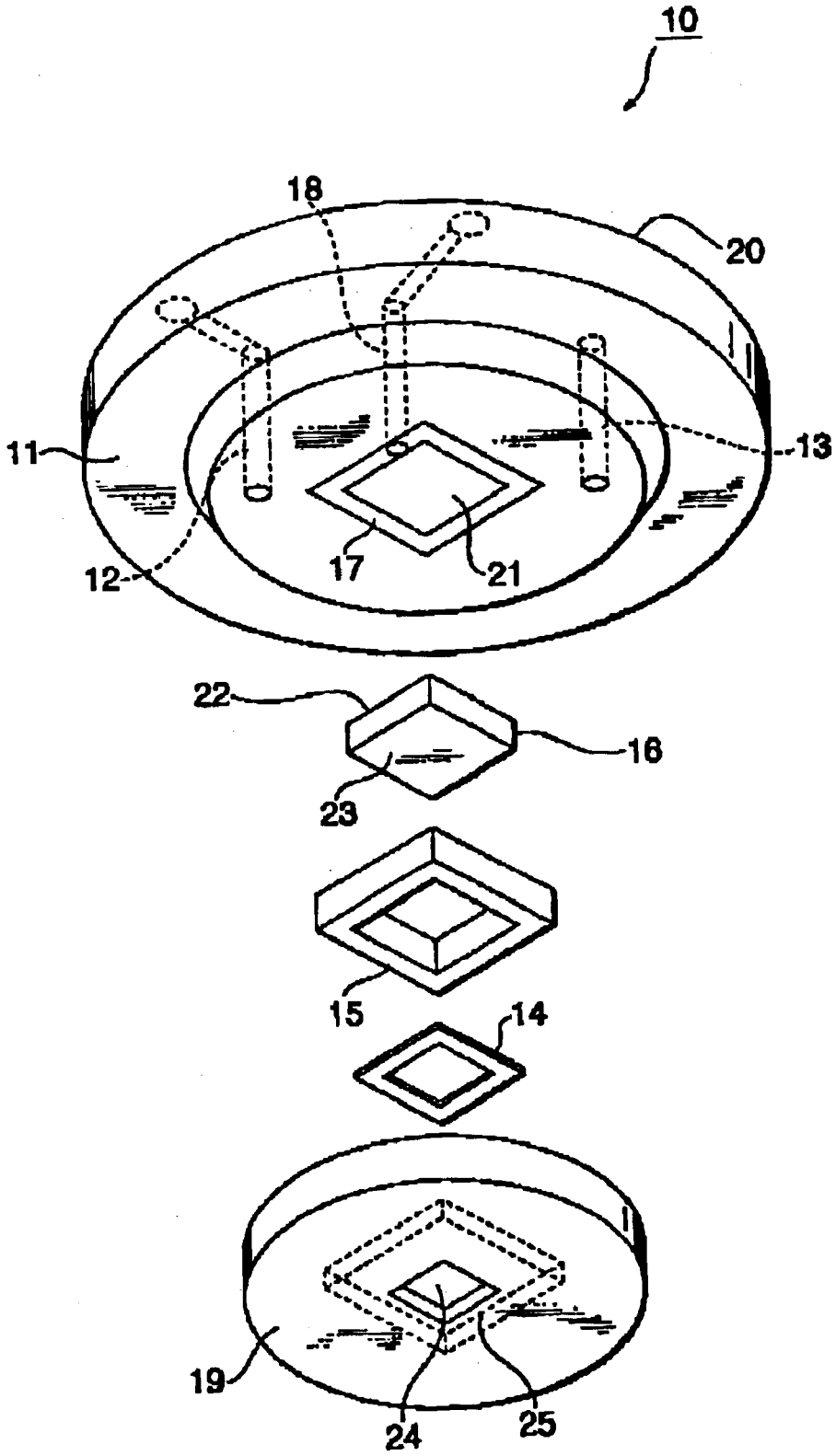
FIG. 2 is an exploded perspective view showing the photocathode according to the first embodiment.
Figure 3:
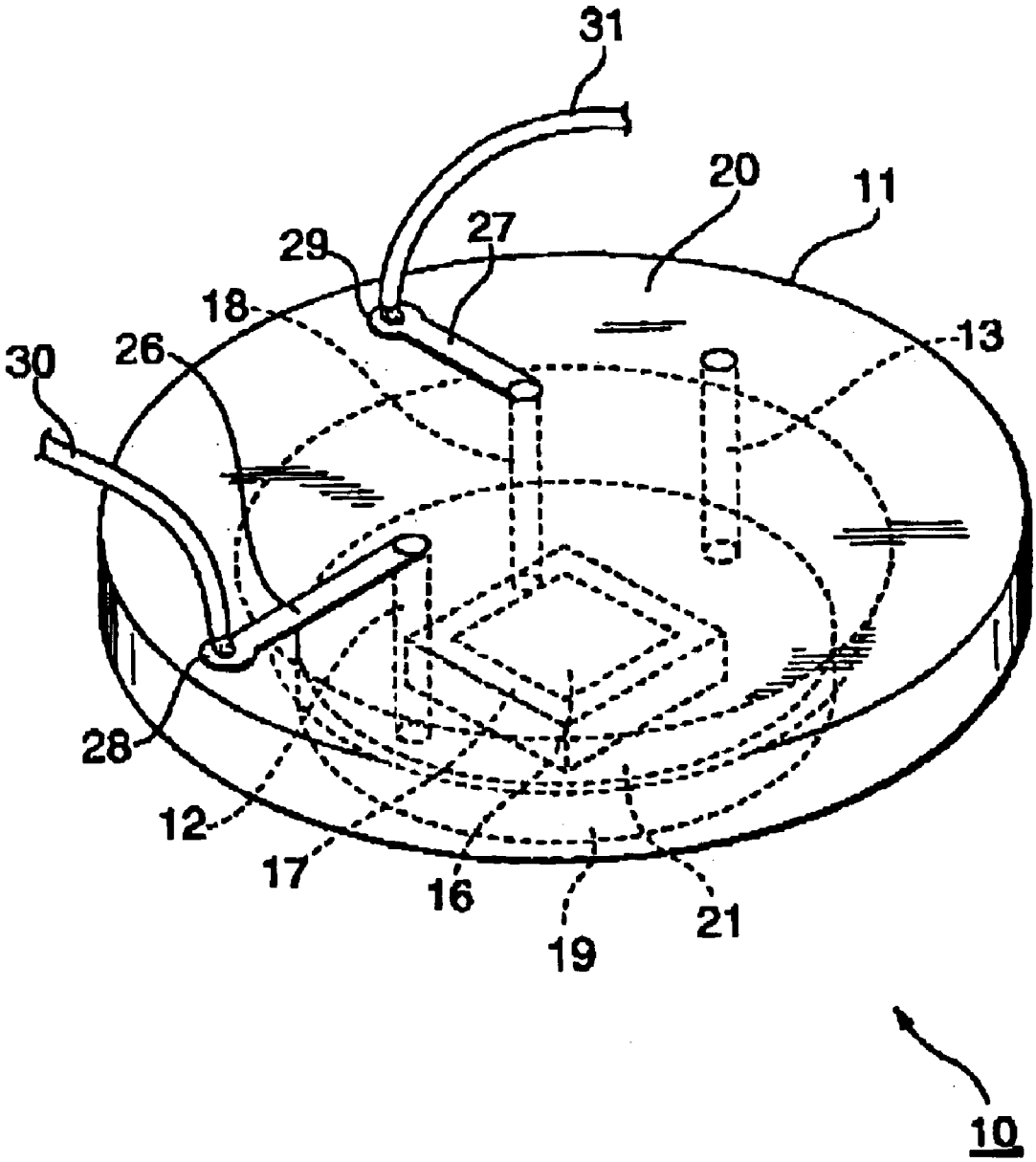
FIG. 3 is a perspective view showing the photocathode according to the first embodiment from the faceplate side.

FIG. 1 is a cross-sectional view showing a photocathode according to a first embodiment. FIG. 2 is an exploded perspective view showing the photocathode of the first embodiment. FIG. 3 is a perspective view showing the photocathode according to the first embodiment from the faceplate side.

As shown in FIGS. 1 and 2, a photocathode 10 includes a faceplate 11 transparent to light; first pins 12 and 13 and a second pin 18 that are embedded in the faceplate 11; a photocathode plate 16 for emitting photoelectrons in response to incident light passing through the faceplate 11; and a support plate 19 for fixing the photocathode plate 16 to the faceplate 11.

The faceplate 11 is a disc plate, for example, formed from a light transmissive material such as glass. The faceplate 11 enables external light to travel from a light incident surface 20 to a light transmissive surface 21.

As shown in FIG. 1, the photocathode plate 16 on which light transmitted through the light transmissive surface 21 of the faceplate 11 impinges is formed from a semiconductive material. The photocathode plate 16 consists of a flat rectangular plate having a light incident surface 22 and an electron emitting surface 23 disposed on the back side of the light incident surface 22. The photocathode plate 16 is positioned such that the light incident surface 22 contacts the center portion of the light transmissive surface 21 of the faceplate 11. Incident light on the light incident surface 22 is photo-electrically converted to photoelectrons, which are emitted from the electron emitting surface 23. By applying a bias voltage to the light incident surface 22 and electron emitting surface 23, an electric field for accelerating the photoelectrons is formed in the photocathode plate 16. Known as a field-assisted photocathode plate, the photocathode plate 16 accelerates photoelectrons generated by incident light and emits the photoelectrons into a vacuum. As shown in FIG. 2, a Cr—In deposition film 17 is deposited on the light transmissive surface 21 in contact with the outer edge of the light incident surface 22 of the photocathode plate 16. The Cr—In deposition film 17 has a rectangular frame shape, and intends to apply the above bias voltage to the light incident surface 22 of the photocathode plate 16.

The first pins 12 and 13 embedded in the faceplate 11 are formed from a metallic material such as Kovar. As shown in FIG. 1 or FIG. 2, the first pins 12 and 13 extend from the incident surface 20 to a part of the light transmissive surface 21 which does not contact the photocathode plate 16. The second pin 18 embedded in the faceplate 11 is also formed from a metallic material, such as Kovar. One second pin 18 extends from a part of the light transmissive surface 21 contacting the photocathode plate 16 to the incident surface 20. The second pin 18 is disposed in contact with the edge of the light incident surface 22 in order not to block light into the light incident surface 22. As shown in FIG. 3, metallized layers 26 and 27 deposited on the incident surface 20 is connected with the end of the first pin 12 and second pin 18, respectively, on the incident surface 20 side. Terminals 28 and 29 on the ends of the metallized layers 26 and 27 are connected to lead wires 30 and 31, respectively. These lead wires are each connected to a power source (not shown). The end of the second pin 18 on the light transmissive surface 21 side is connected to the Cr—In deposition layer 17, as shown in FIGS. 2 and 3.

As shown in FIG. 1 or FIG. 2, the support plate 19 is a disc formed from a metallic material, such as Kovar. The support plate 19 has a rectangular shaped stepped through-hole 24 at its center. The support plate 19 accommodates the photocathode plate 16 in the larger opening forming the stepped through-hole 24. A rim 25 on the smaller opening formed in the stepped through-hole 24 covers the outer edge of the electron emitting surface 23. A spacer 14 serving as a rectangular frame-shaped electrode formed from metal such as stainless steel is interposed between the rim 25 and the outer edge of the electron emitting surface 23. The surface of the support plate 19 facing the faceplate 11 is welded to each end face of the first pins 12 and 13 on the light transmissive surface 21 side. The rim 25 and spacer 14 constitute the rim.

With this construction, the photocathode plate 16 is fixed to the faceplate 11, while the outer edge of the light incident surface 22 is in contact with the Cr—In deposition film 17 on the light transmissive surface 21, as shown in FIG. 2 or FIG. 3.

As shown in FIG. 1 or FIG. 2, an insulating holder 15 formed as a rectangular frame of an insulating material such as a ceramic is provided around the photocathode plate 16. The insulating holder 15 is interposed between the faceplate 11 and the rim 25.

Next, the operations of the photocathode 10 according to the first embodiment will be described. As shown in FIGS. 1 and 3, one end of a bias voltage source necessary for operating the photocathode plate 16 is electrically connected to the electron emitting surface 23 via the lead wire 30, the terminal 28, the metallized layer 26, the first pin 12, the support plate 19, and the spacer 14. The other end of bias voltage is electrically connected to the light incident surface 22 via the lead wire 31, the terminal 29, the metallized layer 27, the second pin 18, and the Cr—In deposition layer 17. When external light (hi) to be detected is incident on the incident surface 20 of the faceplate 11, as shown in FIG. 1, the light passes through the faceplate 11 and impinges on the light incident surface 22 through the light transmissive surface 21. When light is incident on the photocathode plate 16, the light is photoelectrically converted into photoelectrons (−e). At this time, an electric field is formed within the photocathode plate 16 by the bias voltage. The photoelectrons are accelerated by this field toward the electron emitting surface 23 and emitted with high energy from the electron emitting surface 23 into a vacuum.

In the present embodiment, the photocathode plate 16 is interposed between the faceplate 11 and the support plate 19 formed from metal. By welding the metallic first pins 12 and 13 embedded in the faceplate 11 to the support plate 19, the field-assisted type of photocathode plate 16 is easily and readily fixed to the faceplate 11 without using adhesive. Hence, the above structure not only simplifies the production of the photocathode 10, but also prevent peeling of the photocathode plate 16 caused by thermal stress induced by a nearly 100° C. change in temperature when the photocathode and electron tube is cooled to about −70° C. The above structure also prevents a drop in vacuum in the electron tube caused by gas generated by adhesive. Accordingly, the reliability of the photocathode and electron tube is improved.

Since use of the first pin 12 and second pin 18 makes it possible to apply a voltage between both surfaces of the photocathode plate 16 from the top of the faceplate 11, a complicated pattern of lead wires used to apply a bias voltage on the light transmissive surface 21 side of the faceplate 11 (wiring complicated due to the existence of the support plate 19) is not necessary. In addition, construction of the photocathode 10 is simplified, further facilitating production of the photocathode 10. The size of the photocathode 10 is reduced.

Further, by providing the insulating holder 15 around the photocathode plate 16, it is possible to prevent short circuits caused by contact between the side surface of the photocathode plate 16 and the faceplate 11 formed from a metallic material when the photocathode plate 16 moves for any reason. Hence, reliability of the photocathode and electron tube is further improved.

Figure 4:
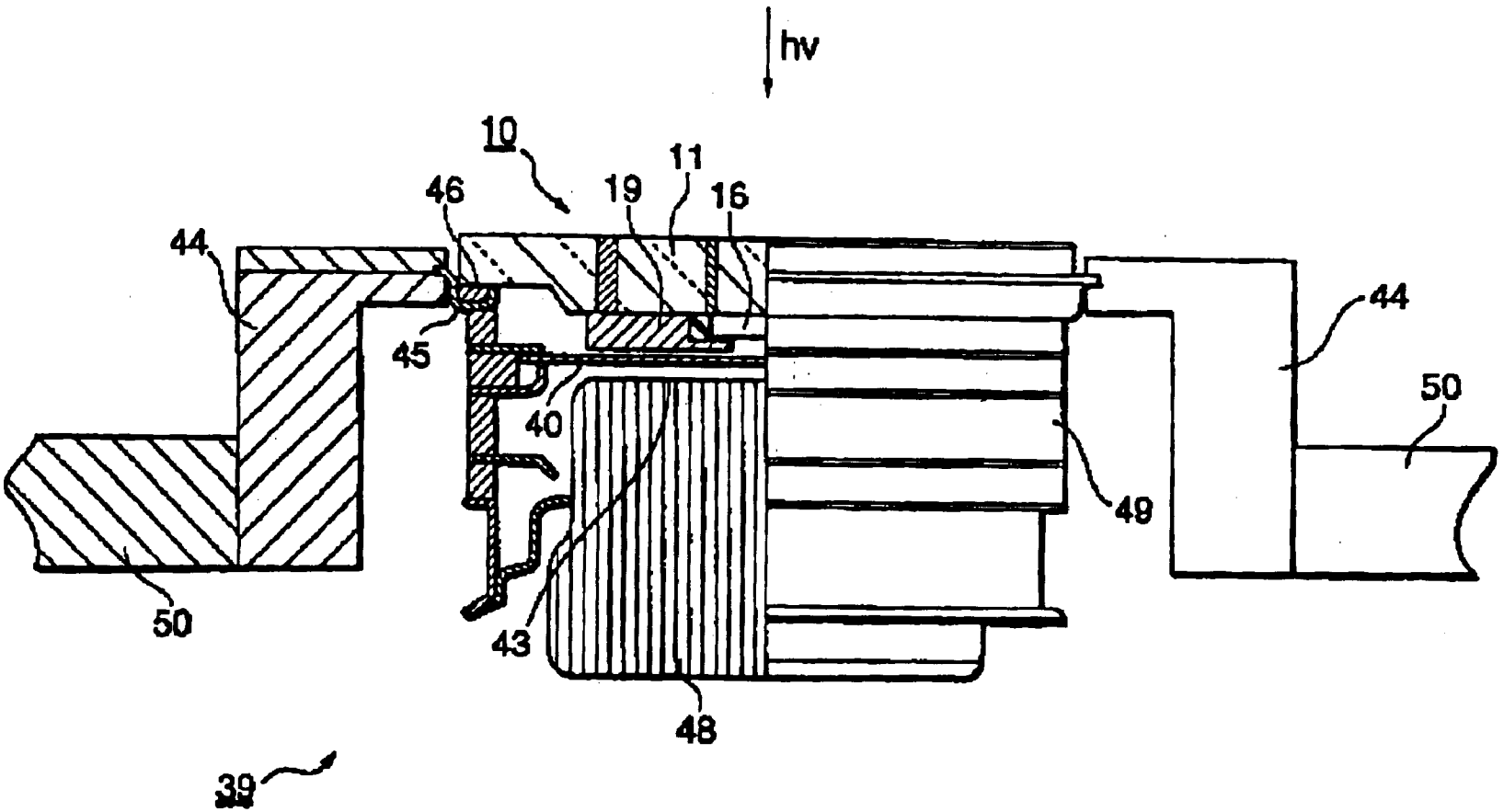
FIG. 4 is a partial cross-sectional view showing an image intensifier equipped with the photocathode of FIGS. 1 to 3.

Next, an image intensifier 39 serving as an electron tube provided with the photocathode 10 of the first embodiment will be described with reference to FIG. 4. Here, the photocathode 10 of the first embodiment is used as the photocathode of the image intensifier 39.

In this image intensifier 39, light incident on the faceplate 11 of the photocathode 10 is photo-electrically converted to photoelectrons in the photocathode plate 16. The photoelectrons are emitted from the photocathode plate 16 onto a microchannel plate (MCP) 40. Photoelectrons impinged on the MCP 40 undergo secondary electron multiplication. The multiplied secondary electrons are emitted onto a phosphor screen 43 positioned on the back side of the MCP 40. The emitted secondary electrons are converted to light by the phosphor screen 43. The converted light is emitted externally via an output window 48. In other words, light impinging on the faceplate 11 is multiplied and emitted from the output window 48 while retaining the two-dimensional data. Here, an outer covering 49 accommodates the MCP 40, the phosphor screen 43, the output window 48. A metal flange 45 for cooling the photocathode plate 16 is interposed between the outer covering 49 and the faceplate 11 of the photocathode 10, and sealed by an Indium (In) seal 46. Hence, the photocathode plate 16 can be cooled by an external cooling device 50 via the metal flange 45 and a cooling plate 44 disposed around the metal flange 45. This construction maintains the photoelectric conversion properties of the image intensifier 39.

As described above, the image intensifier 39 employs the photocathode 10 of the first embodiment as a photocathode, because the photocathode plate 16 can be easily and reliably fixed to the faceplate 11 without adhesive. Therefore, production of the image intensifier 39 is facilitated. Additionally, the generation of gas peeling of the photocathode plate 16 due to vibrations and thermal stress and can be prevented. Accordingly, reliability is improved. Further, a bias voltage can be applied directly from outside of the image intensifier 39 (from the incident surface 20 side of the faceplate 11), forming a complex pattern of lead wires used to apply the bias voltage internally is not necessary. Facilitating the construction of the electrode enables a more compact design. Since the electrode construction can be made more compact, the distance between the photocathode plate 16 and the MCP 40 can be shortened, thereby improving the resolution of the image intensifier 39.

The conventional photocathode disclosed in Japanese patent application publication No. 8-255580 described above has a photoelectric membrane for applying a potential to the periphery of the photocathode 10, thereby making it difficult to efficiently cool the photocathode plate 16 from the side. However, by using the photocathode 10 of the first embodiment in the image intensifier 39, a potential is not applied to the side surface of the photocathode 10, enabling the cooling metal flange 45 to be disposed on the side. Accordingly, the photocathode plate 16 can be cooled efficiently. And the photoelectric conversion performance is readily maintained.

Figure 5:
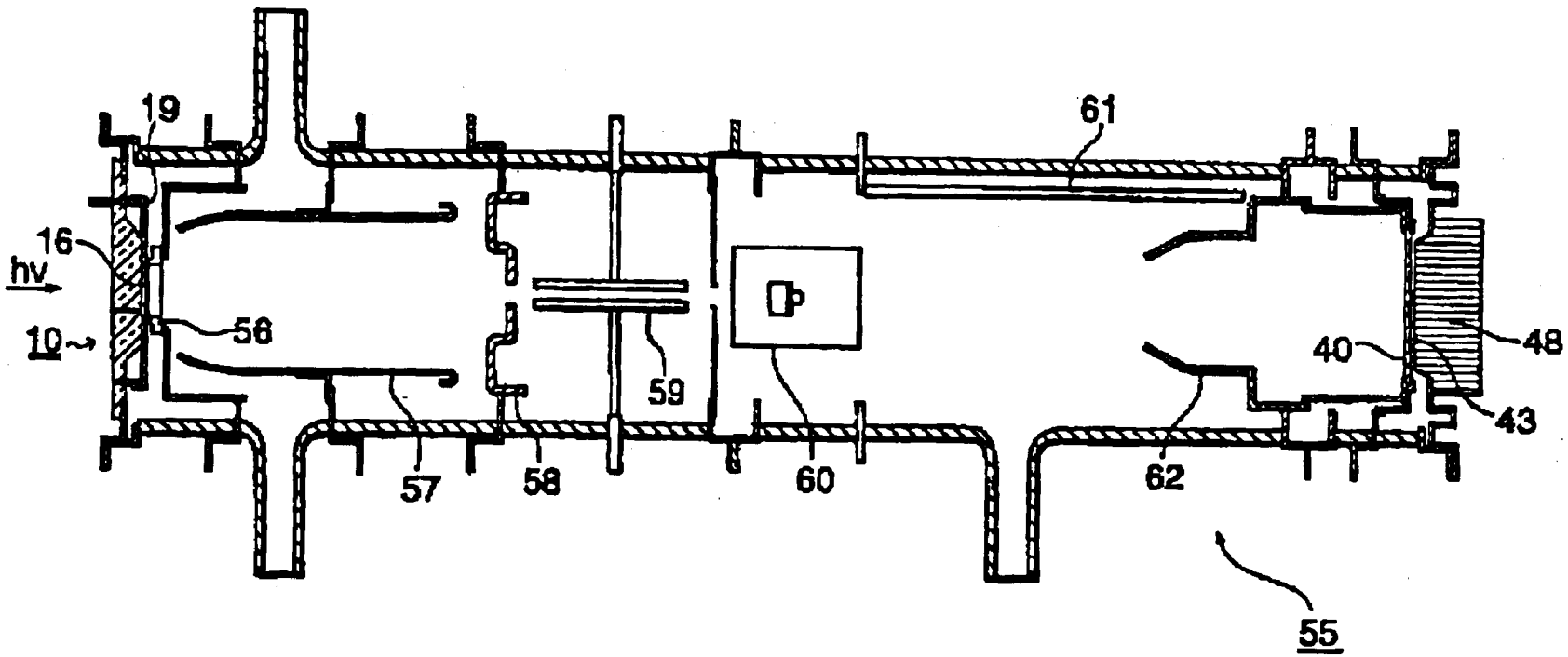
FIG. 5 is a cross-sectional view showing a streak tube equipped with the photocathode of FIGS. 1 to 3.

Next, a streak tube 55 serving as the electron tube provided with the photocathode 10 of the first embodiment will be described with reference to FIG. 5. In the present embodiment, the photocathode 10 of the first embodiment is employed as a photocathode of the streak tube 55. In this streak tube 55, electrons emitted from the photocathode plate 16 in response to incident light are accelerated by an accelerating electrode 56, converged by a converging electrode 57, and further accelerated by an anode 58. Photoelectrons accelerated in this way pass through a deflecting field formed by a deflecting electrode 59. Subsequently, the photoelectrons are guided by a position correcting electrode 60, a wall anode 61, and a cone electrode 62 and impinged on the MCP 40. Electrons impinged on the MCP 40 undergo secondary electron multiplication. The secondary electrons are impinged on the phosphor screen 43 to be converted to light. A streak image is formed on the output window 48.

The streak tube 55 described above has the same effects as the image intensifier 39.

Figure 6:
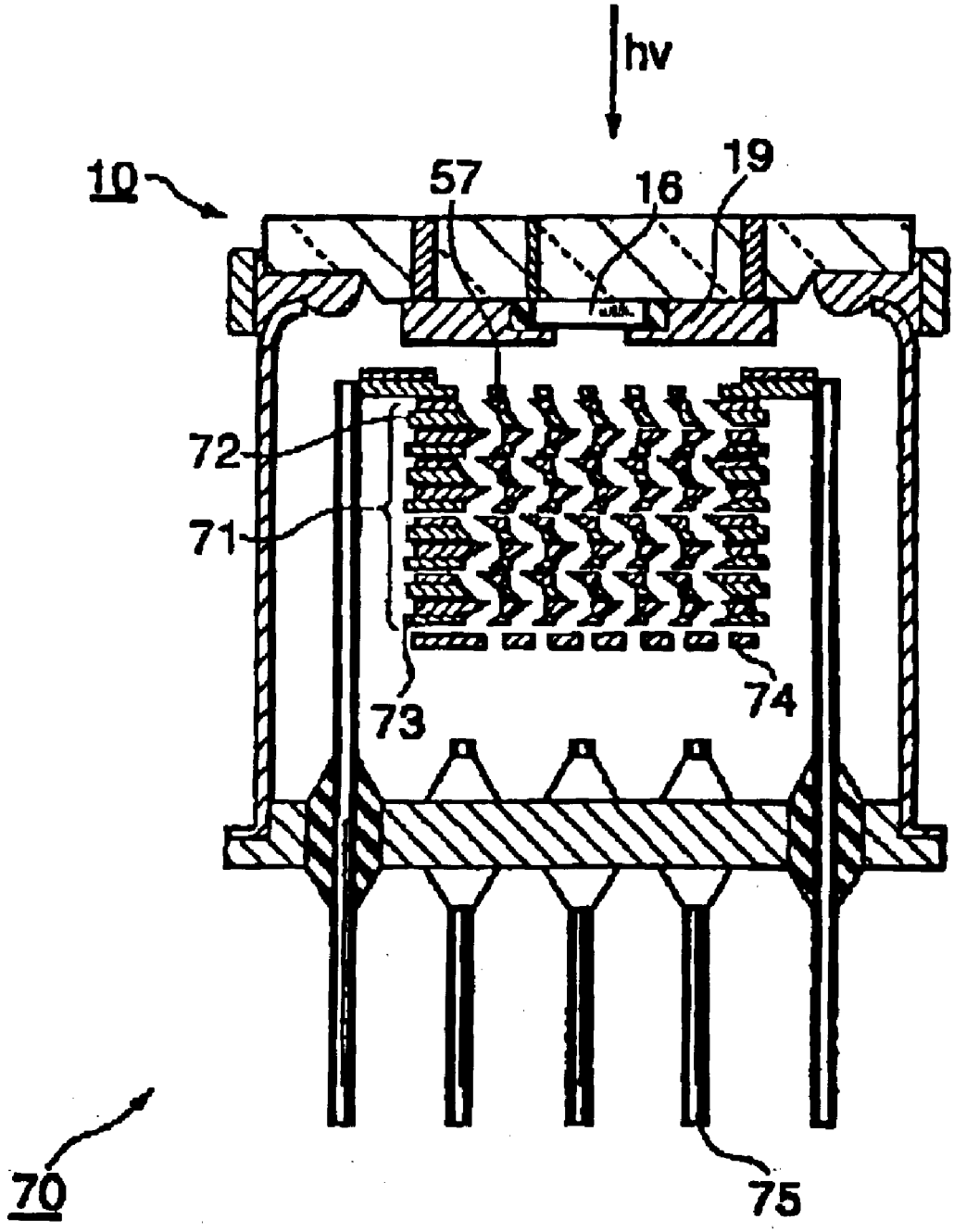
FIG. 6 is a cross-sectional view showing a photomultiplier tube equipped with the photocathode of FIGS. 1 to 3.

Next, a photomultiplier tube 70 serving as the electron tube provided with the photocathode 10 of the first embodiment will be described with reference to FIG. 6. In the present embodiment, the photocathode 10 of the first embodiment is employed as the photocathode of the photomultiplier tube 70. In this photomultiplier tube 70, photoelectrons emitted from the photocathode plate 16 in response to incident light are converged by a lattice-shaped converging electrode 57 onto a first dynode 72 in a photoelectron multiplying unit 71 which is positioned downstream from the converging electrode 57. The first dynode 72 produces secondary electrons multiplied from the incident photoelectrons. These electrons are sequentially multiplied by the subsequent dynodes. A group of secondary electrons multiplied about $10^6$ times are emitted from a final dynode 73. This group of secondary electrons reaches an anode 74, and is emitted externally via stem pins 75 connected to the anode 74.

The photomultiplier tube 70 described above has the same effects as the streak tube 55.

Figure 7:
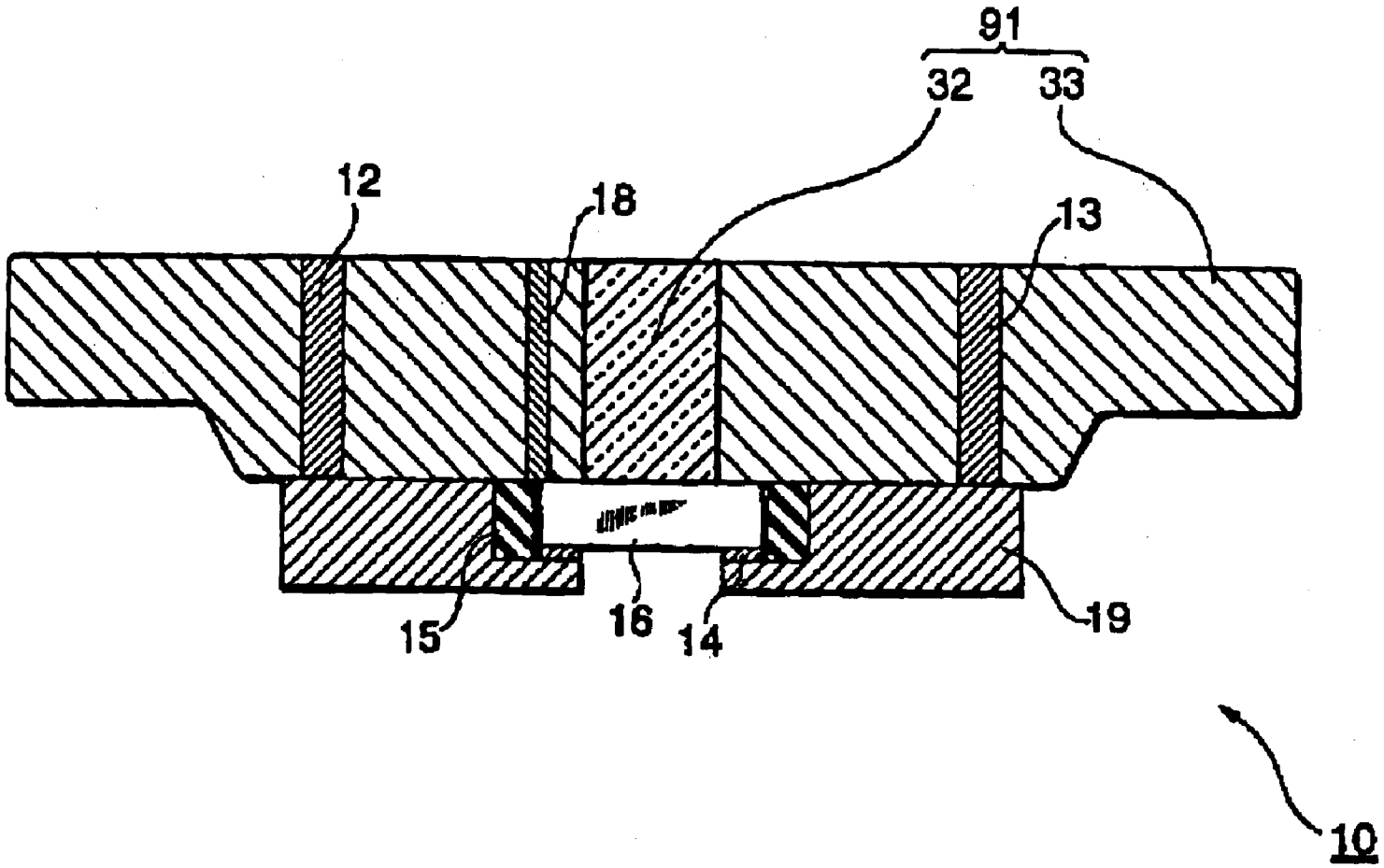
FIG. 7 is a cross-sectional view showing a photocathode according to a second embodiment.

The photocathode according to the present invention is not limited to the embodiment described above, but many modifications and variations can be conceived without departing from the spirit of the invention, the scope of which is defined by the attached claims. In the first embodiment, the entire surface of the faceplate 11 is formed from glass. However, the same functions are sufficiently exhibited when only the portion of the faceplate 11 through which incident light is introduced onto the photocathode plate 16 is formed from a light transmissive material. For example, the photocathode 10 of a second embodiment shown in FIG. 7 employs a faceplate 91 that consists of a glass window 32 formed from glass through which incident light is introduced onto the photocathode plate 16 and a ceramic frame 33 positioned around the glass window 32, the ceramic frame 33 being welded with the glass window. With this construction, the strength of the faceplate 91 can be enhanced while exhibiting the effects of the present invention.

In the first embodiment, two first pins are provided. However, it is possible to provide only one pin to simplify the construction or to provide three or more pins to more reliably fix the photocathode plate 16. The first pin 12 and support plate 19 are welded in the first embodiment as the method of joining. However, soldering can be used instead of the welding.

Further, in the first embodiment, bias voltages are applied to the photocathode plate 16 via each first pin 12 and second pin 18, as a preferable structure, it is also possible to connect the one end of bias voltage source to the photocathode 16 via either the first pin 12 or the second pin 18, and connect the other end of bias voltage source to the photocathode 16 via a lead wire or other means arranged on the light transmissive surface 21 side of the faceplate 11. It is preferable to apply bias voltages cross the photocathode 16 via lead wires or another means disposed on the light transmissive surface 21 side of the faceplate 11.

In the first embodiment, a field assisted photocathode plate 16 is employed for applying a bias voltage. However, a photocathode plate can be used to apply only a negative voltage. In this case, it is preferable to apply a voltage via the first pin 12. However, a voltage can also be applied via the second pin 18 or other means such as a lead wire disposed on the light transmissive surface 21 side of the faceplate 11.

Further, in the first embodiment, the insulating holder 15 can be provided on the side surface of the photocathode plate 16 as a more preferable structure. However, the insulating holder is not necessarily required.

Further, in the first embodiment, the disc having the stepped through-hole 24 is used as the support plate 19. However, the support plate 19 is not limited to this shape, but can be formed as a rectangular plate or also as a supporting unit consisting of a plurality of divided pieces.

Further, in the first embodiment, a bias voltage is applied to the light incident surface 22 of the photocathode plate 16 via the Cr—In deposition film 17 serving as an electrode. The Cr—In deposition film 17 is not necessarily required. In this case, the second pins can be directly connected with the light incident surface 22.

INDUSTRIAL APPLICABILITY

As described above, the present invention can be used in a wide variety of applications under severe conditions such as those requiring high vibration resistance and those in which severed temperature variations generate thermal stress.

What is claimed is:

1. A photocathode comprising:

a faceplate having a light incident surface on which light is incident, and a light transmissive surface for transmitting the incident light;

a photocathode plate in contact with the light transmissive surface of the faceplate for emitting electrons from an electron emitting surface disposed on the opposite side of the surface contact with the light transmissive surface in response to incident light;

at least one first pin embedded in the faceplate the first pin extending between the light incident surface of the faceplate and a portion of the light transmissive surface that does not contact the photocathode plate; and a support plate joined to the first pin on the light transmissive surface, the support plate contacting an outer edge of the electron emitting surface of the photocathode plate to fix the photocathode plate to the faceplate.

2. The photocathode according to claim 1, wherein the first pin and the support plate are formed from metal, the joint of the support plate to the first pin is either of welding and soldering.

3. The photocathode according to claim 2, wherein a voltage is applied to the photocathode plate through the first pin and the support plate.

4. The photocathode according to claim 1, further comprising:

a second pin formed from metal and embedded in the faceplate, the second pin extending between the light incident surface and a portion of the light transmissive surface contacting the photocathode plate to be electrically connected to the photocathode plate, a voltage being applied to the photocathode plate through the second pin.

5. The photocathode according to claim 1, wherein a bias voltage is applied between both surfaces of the photocathode plate.

6. The photocathode according to claim 5, further comprising a second pin formed from metal and embedded in the faceplate, the second pin extending between the light incident surface and a portion of the light transmissive surface contacting the photocathode plate to be electrically connected to the photocathode plate, one end of a bias source for applying a bias voltage across the photocathode being connected to the second pin.

7. The photocathode according to claim 2, wherein the bias voltage is applied between both surfaces of the photocathode plate, one end of a bias source for applying a bias voltage across the photocathode plate is connected to the first pin and the support plate.

8. The photocathode according to claim 7, further comprising a second pin formed from metal and embedded in the faceplate, the second pin extending between the light incident surface and the portion of the light transmissive surface contacting the photocathode plate to be electrically connected to the photocathode plate, the other end of the bias source being connected to the second pin.

9. The photocathode according to claim 5, wherein the support plate is formed from metal, an insulating holder is provided around the photocathode plate.

10. The photocathode according to claim 4, wherein the second pin and the photocathode plate are electrically connected through an electrically conductive member.

11. The photocathode according to claim 1, wherein the faceplate includes a portion for guiding light onto the photocathode plate, only the portion for guiding light onto the photocathode plate is formed from a light transmissive member.

12. The photocathode according to claim 1, wherein the support plate comprises a flat plate having a stepped through-hole, a rim portion of the stepped through-hole contacts the outer edge of the electron emitting surface of the photocathode plate to fix the photocathode plate to the faceplate.

13. An electron tube comprising the photocathode according to claim 1.

14. The electron tube according to claim 13 operating as an image intensifier.

15. The electron tube according to claim 13 operating as a streak tube.

16. The electron tube according to claim 13 operating as a photomultiplier.

17. The photocathode according to claim 2, further comprising:

a second pin formed from metal and embedded in the faceplate, the second pin extending between the light incident surface and a portion of the light transmissive surface contacting the photocathode plate to be electrically connected to the photocathode plate, a voltage being applied to the photocathode plate through the second pin.

18. The photocathode according to claim 2, wherein a bias voltage is applied between both surfaces of the photocathode plate.

* * * * *